US009308765B2

(12) United States Patent
Bartscher et al.

(10) Patent No.: US 9,308,765 B2
(45) Date of Patent: Apr. 12, 2016

(54) DISTRIBUTOR ROLLERS

(75) Inventors: Gerhard Bartscher, Köln (DE); Uwe Zettl, Frechen (DE); Hendrik Ansorge, Köln (DE); Silke Grosse, Dormagen (DE); Birgit Frings, Dormagen (DE)

(73) Assignee: Felix Boettcher GmbH & Co. KG, Cologne (DE)

( * ) Notice: Subject to any disclaimer, the term of this patent is extended or adjusted under 35 U.S.C. 154(b) by 210 days.

(21) Appl. No.: 13/514,527

(22) PCT Filed: Dec. 7, 2010

(86) PCT No.: PCT/EP2010/069046

§ 371 (c)(1),
(2), (4) Date: Oct. 2, 2012

(87) PCT Pub. No.: WO2011/069998

PCT Pub. Date: Jun. 16, 2011

(65) Prior Publication Data

US 2013/0029051 A1 Jan. 31, 2013

(30) Foreign Application Priority Data

Dec. 7, 2009 (EP) ..... 09178216

(51) Int. Cl.

| | |
|---|---|
| ***B41F 31/14*** | (2006.01) |
| ***B41N 7/00*** | (2006.01) |
| ***B41F 31/00*** | (2006.01) |
| ***B41F 31/26*** | (2006.01) |
| ***B41N 7/04*** | (2006.01) |
| ***B41N 7/06*** | (2006.01) |

(52) U.S. Cl.

CPC ..... *B41N 7/005* (2013.01); *B41F 31/00* (2013.01); *B41F 31/002* (2013.01); *B41F 31/14* (2013.01); *B41F 31/26* (2013.01); *B41N 7/04* (2013.01); *B41N 7/06* (2013.01); *B41N 2207/02* (2013.01); *B41N 2207/14* (2013.01)

(58) Field of Classification Search

None

See application file for complete search history.

(56) References Cited

U.S. PATENT DOCUMENTS

| | | | | | |
|---|---|---|---|---|---|
| 4,183,298 | A | * | 1/1980 | Cappel et al. | 101/348 |
| 5,033,380 | A | * | 7/1991 | Sonobe et al. | 101/350.1 |
| 5,099,759 | A | | 3/1992 | Sonobe et al. | |

(Continued)

FOREIGN PATENT DOCUMENTS

| | | | |
|---|---|---|---|
| DE | 10 2007 062940 | A1 | 6/2009 |
| EP | 0 363 887 | A2 | 4/1990 |

(Continued)

OTHER PUBLICATIONS

International Preliminary Report on Patentability issued in counterpart International Application No. PCT/EP/2010/069046 dated Jun. 12, 2012.

(Continued)

*Primary Examiner* — Erma Cameron

(74) *Attorney, Agent, or Firm* — Venable LLP; Steven J. Schwartz; Tamatane J. Aga

(57) ABSTRACT

Use of a rigid roller obtainable by a method comprising the steps:

providing a roller core;

applying a liquid coating composition based on a polyimide or polyamide-imide prepolymer with a layer thickness of 1 to 1000 μm;

solidifying the liquid coating composition on the roller core;

as an distributor or Rilsan roller.

26 Claims, 1 Drawing Sheet

(56) References Cited

U.S. PATENT DOCUMENTS

| | | | | |
|---|---|---|---|---|
| 5,113,760 | A * | 5/1992 | Sonobe et al. | 101/348 |
| 5,678,153 | A * | 10/1997 | Okamoto et al. | 399/327 |
| 5,957,052 | A * | 9/1999 | Endisch et al. | 101/375 |
| 2004/0187720 | A1* | 9/2004 | Naniwa et al. | 101/457 |
| 2004/0263592 | A1* | 12/2004 | Schmitt | 347/88 |
| 2008/0134916 | A1* | 6/2008 | Luckhardt et al. | 101/425 |
| 2009/0241789 | A1* | 10/2009 | Baecker | 101/352.11 |
| 2009/0320700 | A1* | 12/2009 | MacFarlane | 101/329 |
| 2011/0025752 | A1* | 2/2011 | Law et al. | 347/20 |

FOREIGN PATENT DOCUMENTS

| | | | |
|---|---|---|---|
| EP | 0 942 833 | B1 | 7/2001 |
| JP | 01-093397 | A | 4/1989 |
| JP | 05-301336 | A | 11/1993 |
| WO | WO-2009/080003 | A1 | 7/2009 |

OTHER PUBLICATIONS

Notice of Reasons for Rejection mailed Jun. 24, 2014 in related Japanese Patent Application No. 2012-542510.

* cited by examiner

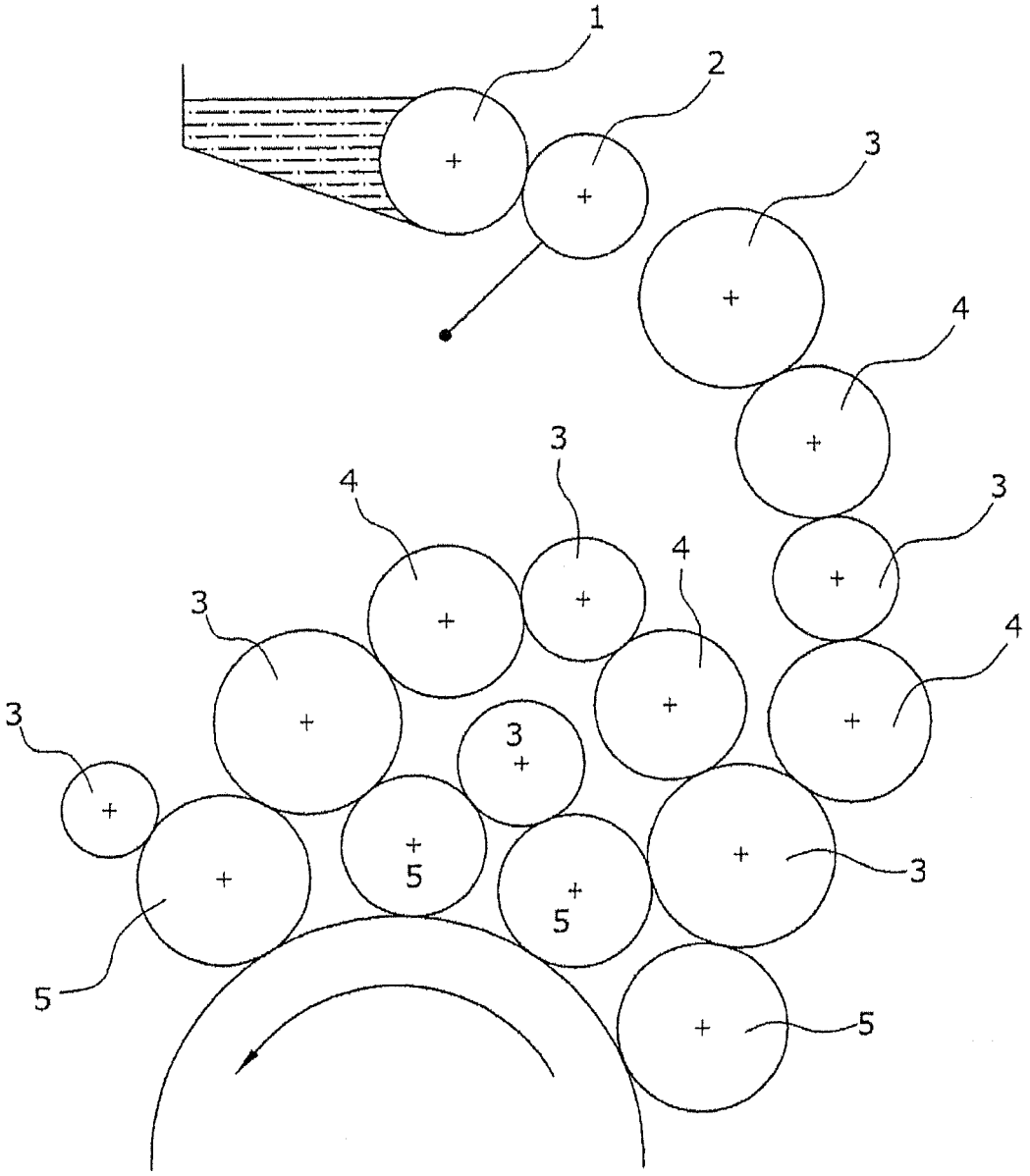
1
2
3
4
3
4
3
4
3
4
3
3
3
5
5
5
5

DISTRIBUTOR ROLLERS

The present application relates to a process for producing a rigid roller, to a rigid roller, and to the use thereof.

This application is a national stage application of PCT/EP 2010/069046, published as WO 2011/069998, which was filed on Dec. 7, 2010, which claims priority to European Patent Application No. 09178216.9, filed Dec. 7, 2009.

Offset printing is still the dominating technology among printing methods. It is an indirect printing method employed in newspaper, magazine, catalogue and packaging printing etc. In offset printing, a printing forme, typically a thin aluminum plate, is prepared. It is fastened under tension to a plate cylinder and has contact with inking and damping systems in the printing machine. Lipophilic regions of the printing forme accept printing ink, while hydrophilic regions remain free from ink.

From the plate cylinder, the printing ink is transferred onto the printing blanket, which is mounted on a blanket cylinder or offset cylinder. The blanket cylinder then transfers the ink to the medium to be printed with the aid of an impression cylinder or of another blanket cylinder.

In order to achieve a uniform ink film, the ink is applied from the reservoir through a specific inking system. In the inking system, the ink is typically transported over the ink roller mill by means of a number of rollers. Rigid rollers (distributor rollers) and elastic rollers (ink rollers) are alternating therein.

The distributor rollers typically consist of a steel core with a coating of Rilsan and are therefore also often referred to as Rilsan rollers. These are usually produced by the following method: The naked steel core is heated and then introduced while rotating into a bath of Rilsan powder (a specific type of polyamide). The Rilsan powder melts upon contact with the hot core and thus provides for a relatively uniform coating. The surface quality of the coating is by far insufficient for application in offset printing, so that it has to be processed, for example, by a grinding process.

Disadvantages of this method include costs (expensive grinding process and the ablation of material that was previously coated) and a high layer density. It is complicated to achieve a layer thickness of below about 100 μm. However, this is desirable, in particular, if internally cooled distributor rollers are employed, as is necessary today in many printing machines. Too thick a coating prevents an effective dissipation of heat from the surface of the distributor roller.

EP 0 942 833 B1 describes an ink roller in which an elastomeric coating material, for example, polymeric nitrile/butadiene, phenolic resin, epoxy resin, polyurethane and other materials, are applied to a roller.

DE 10 2007 062 940 describes rollers in which the coating at least predominantly consists of fluorinated polymers.

It is the object of the present invention to provide processes for producing rollers and rollers that overcome the above mentioned disadvantages of the prior art.

This object is achieved by a process for producing a rigid roller, comprising the steps of:

providing a roller core;

applying a liquid coating composition based on a polyimide or polyamide-imide prepolymer with a layer thickness of 1 to 1000 μm; and solidifying the liquid coating composition on the roller core;

wherein the temperature of said roller is controlled by internal heating or cooling.

Thus, according to the invention, a roller core is provided in the first step. Typical roller cores are made of metal, especially steel and aluminum. However, they may also be non-metallic roller cores, for example, made of ceramic, glass-fiber reinforced plastic (GFRP) or carbon-fiber reinforced plastic (CFRP).

The roller core according to the invention is intended for a roller with internal heating or cooling. Rollers with internal heating or cooling are rollers whose temperature can be controlled by means of a heat transfer medium. The heat transfer medium may be a liquid or even temperature-controlled air. Temperature-control systems are usually employed for cooling. Corresponding rollers are known, for example, from DE 93 169 324.

In one embodiment, the roller core may have a roughness Rz of from 0.1 to 100 μm, preferably from 1 to 30 μm.

A liquid coating composition is applied to said roller core. The coating composition essentially comprises polyimide or polyamide prepolymers. Polyimides are polymers containing a (C═O)—NR—(C═O) group. Polyamide-imides are copolymers consisting of polyimide (C═O)—NR—(C═O) and polyamide (C═O)—$NR_2$ units. Starting materials for the preparation of polyimides are preferably aromatic and aliphatic diamines with aromatic tetracarboxylic acid dianhydrides; diisocyanates may also be employed instead of the diamines. In the first step, a polyamic acid is formed, which then reacts further to form a polyimide. In contrast, starting materials for polyamide-imides are preferably aromatic tricarboxylic acid anhydrides with aromatic or aliphatic diamines or diisocyanates.

"Prepolymers" means mixtures of reactive monomers that have partially, but not completely reacted to form the polymer. In the case of the polyimide or polyamide-imide prepolymers, the curing reaction is performed after the application to the roller core. The curing is achieved or accelerated by heating.

As the layer thickness, a range of from 1 to 1000 μm has been found suitable in principle, a range of from 10 to 200 μm or from 20 to 120 μm being preferred.

Even if the coating composition is employed essentially on the basis of a polyimide or polyamide-imide prepolymer, it may contain further materials, especially fillers, additives, colorants etc. Preferably, the coating composition contains a polyimide or polyamide-imide prepolymer as its main constituent (≥50% by weight).

In one embodiment, the coating composition contains only polyimide prepolymers as said prepolymers.

In another embodiment, the coating composition contains only polyamide-imide prepolymers.

In another embodiment, the coating composition contains both polyimide prepolymers and polyamide-imide prepolymers.

Another embodiment is a roller in which the coating composition contains a polyimide prepolymer, and polyamides or polyamide-imides are additionally contained in the coating composition.

Another embodiment is a roller in which the coating composition contains dissolved polyimides instead of imide prepolymers.

In one embodiment, the coating composition additionally contains polyamides or polyamide prepolymers. Preferably, the ratio of polyimide prepolymers to polyamides+polyamide prepolymers is from 10:0 to 10:9.

In particular, the coating composition may also contain dissolved polyamide-imide.

Suitable methods for applying the liquid coating composition include, in particular, spraying, knife coating, thin-film spin casting, or ring coating.

After the application, the liquid coating composition will solidify by a curing process, i.e., a further reaction to form the polymer. If the prepolymer contains a solvent, the solidification is supported by the drying/evaporating of the solvents. The material applied according to the invention preferably has a surface that is so uniform and of a high quality that grinding of the coating composition is not required after the curing.

This results in a low layer thickness for a sufficient dissipation of heat and low production costs. In addition, the roller according to the invention has excellent properties for the printing process: high wear resistance, high chemical resistance, good ink reception, good ink release, and good cleaning properties. These properties also result from the fact that the surface is not ground, thus not having any pores and thus also being resistant to deposits from the printing process.

The invention also relates to a rigid roller with internal heating or cooling, obtainable by the process according to the invention. The roller according to the invention is characterized by a roller core and a solidified, preferably unground, polyimide-based coating provided thereon in a layer thickness of from 1 to 1000 μm.

The coating of the roller according to the invention may have a modulus of elasticity within a range of from 0.5 to 500 MPa.

In one embodiment, the roller core has a roughness Rz of from 0.1 to 100 μm, preferably from 1 to 30 μm. The application of the coating composition may result in a reduction of roughness. As a rule, the roughness of the solidified coating is lower than the roughness of the roller core.

The invention also relates to a process for adjusting a predetermined roughness of the roller, in which a roller core having a defined roughness is coated to obtain a roller having a defined roughness of the coating composition.

In particular, the roller according to the invention is suitable for rollers with internal heating or cooling and/or oscillating rollers. Rollers with internal heating or cooling are used in order to dissipate heat from the rolling process and thus provide for uniform printing conditions. "Oscillating" means that the roller in operation (i.e. in a rotating condition) is reciprocated axially in order to thereby achieve an improved uniformity of the ink film.

However, the rollers having a coating based on polyimide or polyamide-imide are advantageous not only as rollers with internal heating or cooling, but also in a form without heating or cooling. On the one hand, the production thereof is facilitated by the fact that grinding of the surface is not necessary. In particular, the roughness of the coating can be set by selecting the roughness of the roller core and the thickness of the coating.

Therefore, the invention also relates to the use of a rigid roller obtainable by a process comprising the steps of:

providing a roller core;

applying a liquid coating composition based on a polyimide or polyamide-imide prepolymer with a layer thickness of 1 to 1000 μm;

solidifying the liquid coating composition on the roller core;

as an distributor or Rilsan roller.

The invention further relates to an inking system comprising rigid distributor rollers and elastic rollers, wherein at least one rigid roller is a roller obtainable by a process comprising the steps of:

providing a roller core;

applying a liquid coating composition based on a polyimide or polyamide-imide prepolymer with a layer thickness of 1 to 1000 μm;

solidifying the liquid coating composition on the roller core.

The rollers according to the invention are suitable, in particular, as distributor and Rilsan rollers. Their preferred fields of application are in offset printing.

The invention is further illustrated by the following Examples.

BRIEF DESCRIPTION OF THE DRAWING

FIG. 1 shows an inking system with an ink fountain roller 1, a doctor roller 2, distributor rollers 3, transfer rollers 4, and ink forme rollers 5.

EXAMPLE 1

A solution of polyamic acid is applied to a steel core by a thin film spin casting process. The material is heated in a rotating condition, so that a substantial part of the solvent evaporates. This causes the coating composition to remain stable after the end of the rotation. Subsequently, the roller is annealed at up to 250° C. Printing experiments with such a roller provided excellent results.

EXAMPLE 2

In the process according to Example 1, a steel core with a roughness Rz of 15 μm was employed. In a coating with a thickness of 80 μm according to Example 1, an Rz of about 2.2 μm remains on the surface. In a coating with a layer thickness of 30 μm, an Rz of about 5 μm remains, i.e., the roughness of the coating can be adjusted by selecting the coating thickness.

The invention claimed is:

1. A method comprising utilizing a roller as a distributor roller in a printing process, said roller produced by a process comprising the steps of:

providing a roller core;

applying a liquid coating composition based on a polyimide or polyamide-imide prepolymer;

solidifying the liquid coating composition on the roller core, the solidified coating having a thickness;

wherein the thickness of the solidified coating is 1 to 1000 μm.

2. The method of claim 1, wherein said utilization is in an offset printing process.

3. The method of claim 1, wherein said roller comprises a roller core and a solidified coating based on a polyimide or polyamide-imide, the solidified coating having a thickness of 1 to 1000 μm.

4. The method of claim 1, wherein said roller core has a roughness Rz of from 0.1 to 100 μm.

5. The method of claim 4, wherein said roller core has a roughness Rz of from 1 to 30 μm.

6. The method of claim 1, wherein the coating composition additionally contains at least one selected from the group of polyamide, polyamide prepolymers, polyamide-imides, fillers, additives, colorants, and mixtures thereof.

7. The method of claim 1, wherein the thickness of the solidified coating is within a range of from 10 to 200 μm.

8. The method of claim 7, wherein the layer thickness of the solidified coating is within a range of from 20 to 120 μm.

9. The method of claim 1, wherein the application of the liquid coating composition is performed by spraying, knife coating, thin-film spin casting, or ring coating.

10. The method of claim 1, wherein said solidification of the coating composition is effected by curing the prepolymer, optionally together with drying a solvent from the coating composition.

11. The method of claim 1, wherein said coating composition is not ground after the solidification.

12. The method of claim 1, wherein the modulus of elasticity of the solidified coating composition is within a range of from 0.5 to 500 MPa.

13. The method of claim 1, wherein the roughness of the roller core is higher than the roughness of the solidified coating composition.

14. The method of claim 1, wherein said roller is an internally heated or cooled and/or an oscillating roller.

15. The method of claim 1, wherein the layer thickness is selected to achieve a predetermined roughness of the roller.

16. A method of making a distributor roller for use in a printing process, comprising the steps of:

providing a roller core;

applying a liquid coating composition based on a polyimide or polyamide-imide prepolymer; and solidifying the liquid coating composition on the roller core, the solidified coating having a thickness;

wherein the thickness of the solidified coating is 1 to 1000 μm;

wherein the temperature of said roller is controlled by internal heating or cooling.

17. The method of claim 16, wherein said application of the liquid coating composition is performed by spraying, knife coating, thin-film spin casting, or ring coating.

18. The method of claim 16, wherein said solidification of the coating composition is effected by curing the prepolymer, optionally together with drying a solvent from the coating composition.

19. The method of claim 16, wherein said coating composition is not ground after the solidification.

20. The method of claim 16, wherein the coating composition additionally contains at least one selected from the group of polyamide, polyamide prepolymers, polyamide-imides, fillers, additives, colorants, and mixtures thereof.

21. A roller with internal heating or cooling, produced by the method of claim 16.

22. The method of claim 16, wherein the layer thickness is selected to achieve a predetermined roughness of the roller.

23. An inking system comprising at least one distributor roller and at least one elastic roller for use in a printing process, wherein at least one distributor roller is a roller produced by a process comprising the steps of:

providing a roller core;

applying a liquid coating composition based on a polyimide or polyamide-imide prepolymer;

solidifying the liquid coating composition on the roller core, the solidified coating having a thickness;

wherein the thickness of the solidified coating is 1 to 1000 μm.

24. The inking system of claim 23, wherein the layer thickness is selected to achieve a predetermined roughness of the roller.

25. The inking system of claim 23, wherein the distributor roller is relatively more rigid than the at least one elastic roller.

26. A process for adjusting a roughness of a distributor roller for use in a printing process, comprising the following steps:

providing a roller core having a defined roughness;

applying a liquid coating composition based on a polyimide or polyamide-imide prepolymer;

solidifying the liquid coating composition on the roller core;

wherein a layer thickness of the solidified coating is selected to achieve a predetermined roughness of the roller.

* * * * *